US006089180A

United States Patent [19]

Nichols, Jr.

[11] Patent Number: 6,089,180

[45] Date of Patent: Jul. 18, 2000

[54] MULTI-TIME INDICATING POST MANUFACTURE CONTAINER DOUBLE CLOSURE AND PILL CUP SEPARATOR ASSEMBLY

[76] Inventor: Ernest Nichols, Jr., 5100 Equestrian Way, Pittsburg, Calif. 94565

[21] Appl. No.: 09/025,055

[22] Filed: Feb. 17, 1998

[51] Int. Cl.[7] ..... G09F 9/00

[52] U.S. Cl. ..... 116/309; 116/308; 116/319; 206/534; 206/459.1; 215/230

[58] Field of Search ..... 116/308, 309, 116/306, 316, 317, 319, 321; 206/459.1, 534; 215/217, 218, 219, 220, 221, 230, 234

[56] References Cited

U.S. PATENT DOCUMENTS

| | | | |
|---|---|---|---|
| 675,364 | 5/1901 | Burton | 116/308 |
| 2,528,259 | 10/1950 | Annunziata | 116/308 |
| 2,739,564 | 3/1956 | North | 116/308 |
| 3,446,179 | 5/1969 | Bender | 116/308 |
| 3,818,858 | 6/1974 | Kramer et al. | 116/308 |
| 3,960,713 | 6/1976 | Carey | 116/308 |
| 4,440,306 | 4/1984 | Van Buskirk et al. | 215/230 |
| 4,802,438 | 2/1989 | DeJonge | 116/308 |
| 5,011,032 | 4/1991 | Rollman | 116/321 |
| 5,482,163 | 1/1996 | Hoffman | 116/309 |

*Primary Examiner*—Andrew H. Hirshfeld

*Attorney, Agent, or Firm*—Harris Zimmerman

[57] ABSTRACT

A method and apparatus for providing a multi-time indicating container, closure, and pill cup separator, comprising a common post manufactured container, with a round upper portion such as a round neck or a round body. The container further comprises a newly added rotatable pointer which is attached around the upper round portion of the container. The pointer can be attached to any post manufactured container with an upper round portion. The container further includes indicia which is applied around the upper portion of the container just below the rotatable pointer. The container further includes a post manufactured, separable double closure, which is separated using a double closure separator comprising a locking C-clamp having one standard round clamping tip and one newly added separator wedge blade tip. Separation of the closures allows time indicating indicia to be applied to the inner threaded closure side wall and enables installation of a view hole in the outer closure side wall, prior to rejoining the closures. A post manufactured independent miniature pill cup separator includes thin annular rim adapted to rest on the rim of the main container, and a closure-less pill cup separator body extending from the annular rim and disposed inside the container body. The pill cup separator is a top-less secondary container, and is sealed when the threaded inner closure is joined to the container body. The pill cup separator is used to separate a predetermined number of dosages from the main supply of pill dosages.

2 Claims, 5 Drawing Sheets

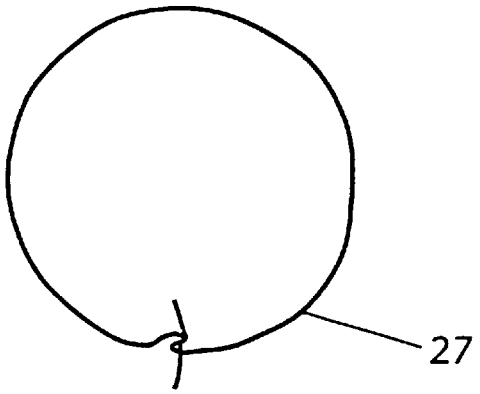
FIG. 4
FIG. 3
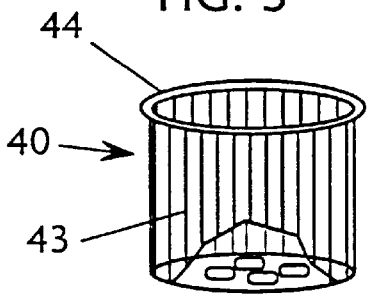
FIG. 13
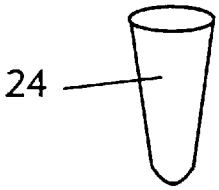
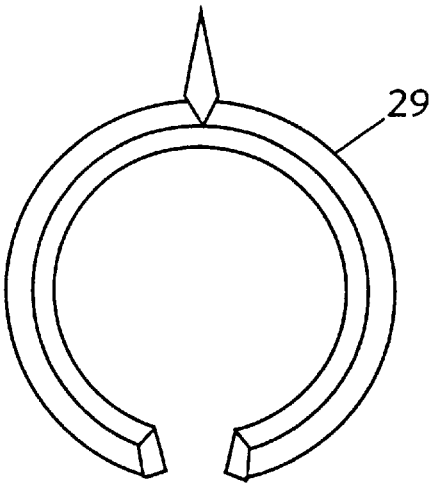
FIG. 2
FIG. 1
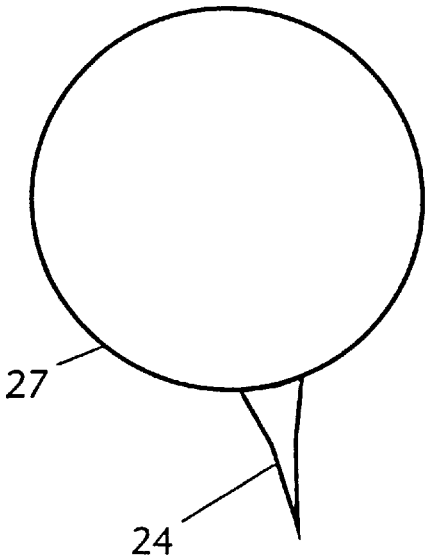

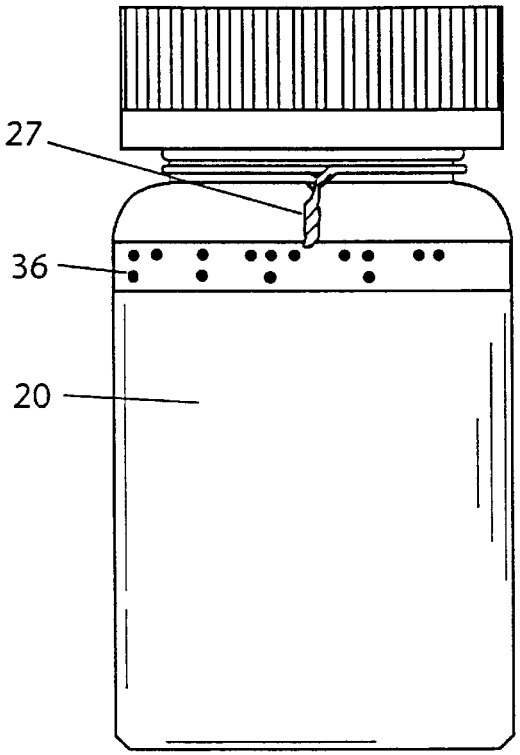
FIG. 8
FIG. 5
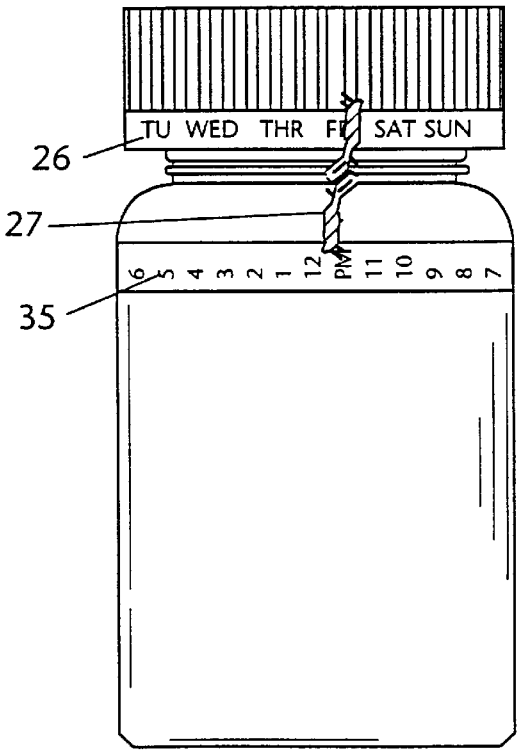

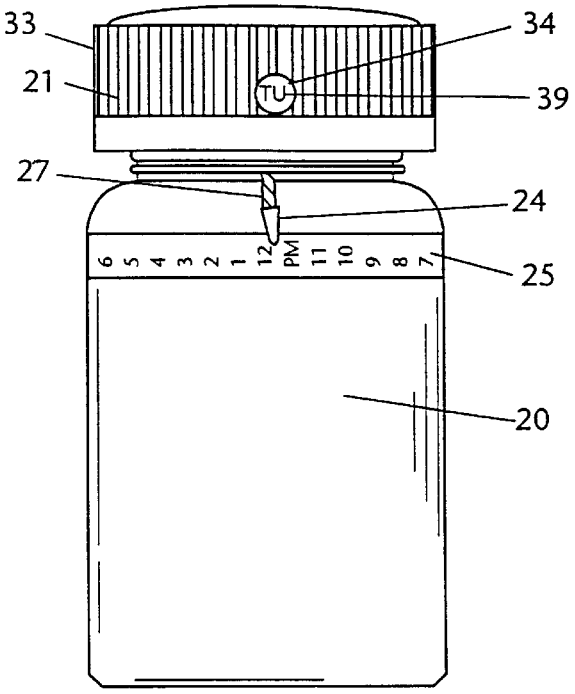
FIG. 7
FIG. 6
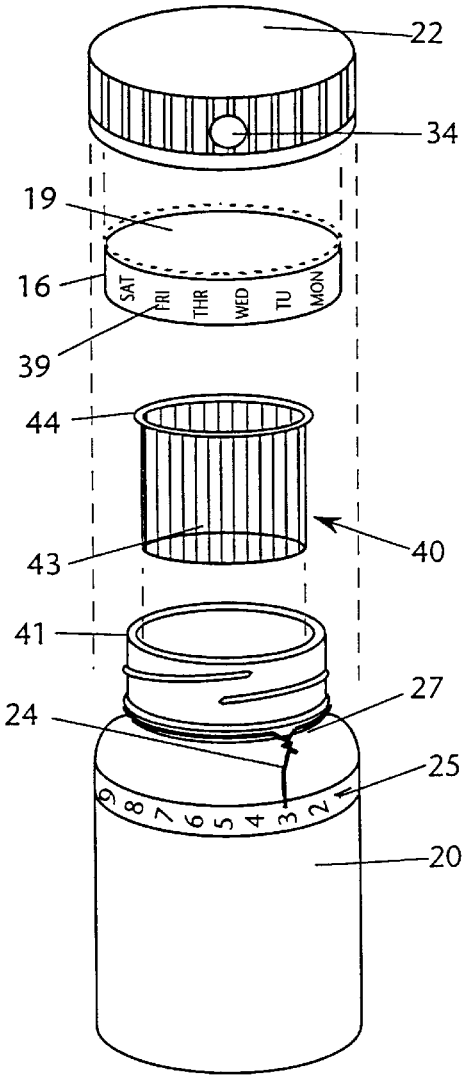

FIG. 12
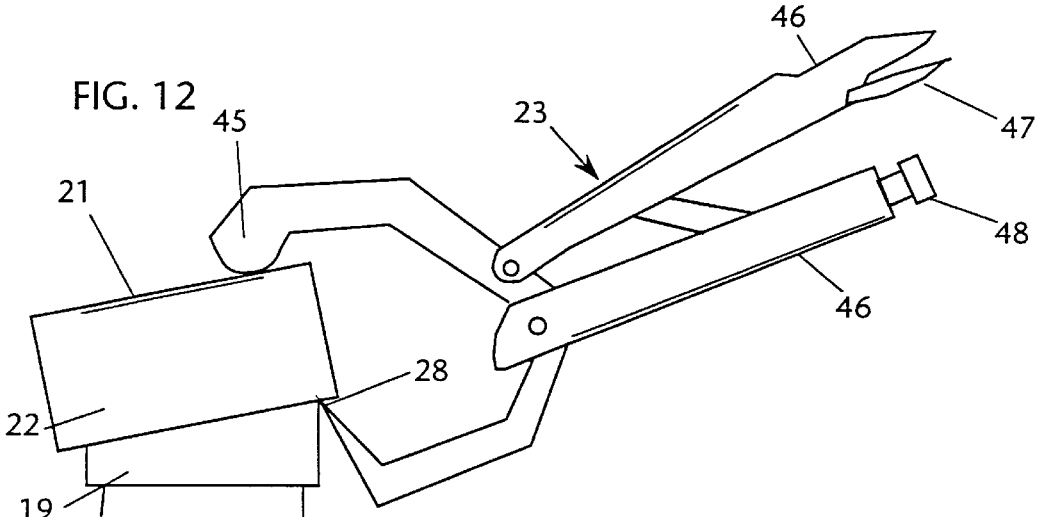
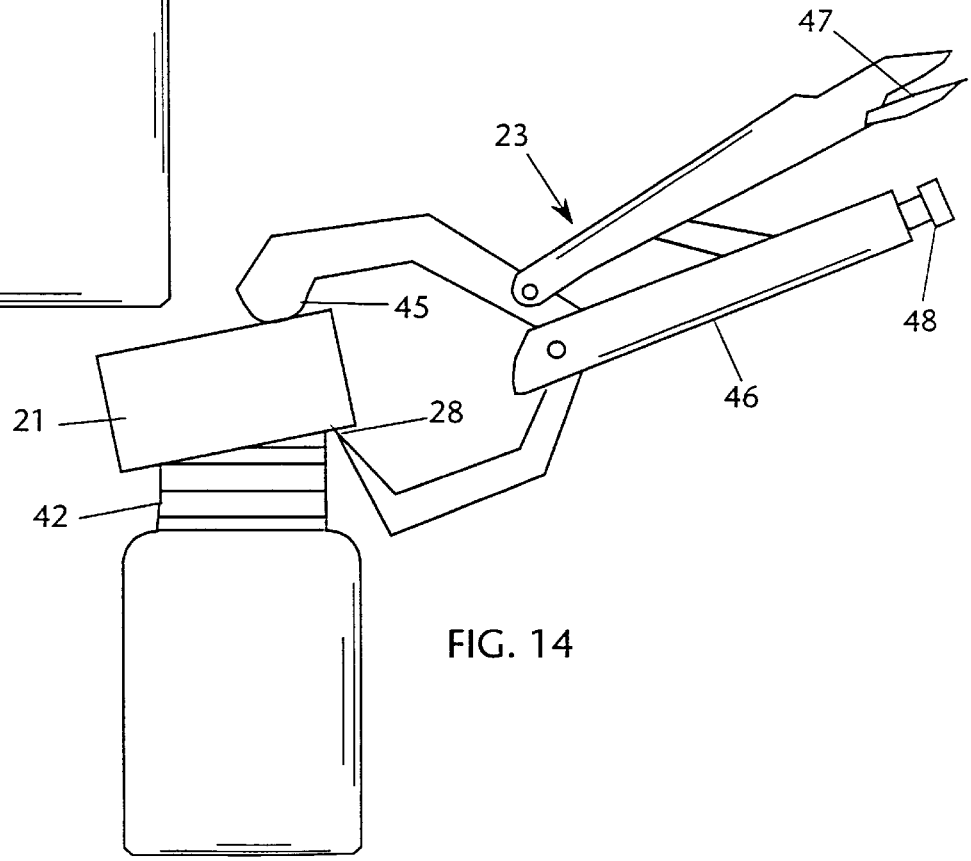
FIG. 14

MULTI-TIME INDICATING POST MANUFACTURE CONTAINER DOUBLE CLOSURE AND PILL CUP SEPARATOR ASSEMBLY

BACKGROUND OF THE INVENTION

The invention relates to a method of using existing common post manufacture containers and closures to make time indicator containers and closures, comprising a container body having an attachable rotatable pointer, a separable double closure having two closures, the outer closure and the threaded inner closure being separable using a double closure separator tool, and a post manufacture pill cup separator which is a post manufacture miniature cup container used for separating a predetermined number of dosage from the main supply of pill dosages in the main container body.

BACKGROUND OF THE PRIOR ART

The time indicating containers of the present invention are post manufacture containers and separable double closures converted into time indicating devices by installing an independent rotatable pointer to enable any post manufacture container with a round upper portion to be made into a time indicating device, whereas Bender's time indicating rotatable pointer (U.S. Pat. No. 3,446,179) is permanently attached to the container at the time of manufacturing, and is limited to the manufacturer's model only, whereas the present invention is installed after the manufacturing of the container, making the present invention's time indicating container a major improvement over Benders time indicating container (U.S. Pat. No. 3,446,179). Bender's secondary container is physically, permanently attached to the closure and again it is limited to usage to the manufacturer's model only. It cannot be installed around other post manufacture containers whereas the secondary container of the present invention can be installed in any post manufacture container body with a compatible container opening, and is not limited to any one model of container, making the present invention a major improvement.

Kramer (U.S. Pat. No. 3,818,858) shows indicating labels that were installed at the time of manufacturing, limiting the labeling to the manufactured containers only. The present time indicating indicia is applied on post manufacture containers and closures after manufacturing, which is a major improvement over the Kramer device (U.S. Pat. No. 3,818,858). The present invention further emphasizes separating post manufacture double closures to make time indicating closures, and is unlike the known prior art. Van Buskirk (U.S. Pat. No. 4,440,306) describes a closure having view holes on outer closure cap outer side walls and on the top of the outer closure to view time indicating indicia on the inner closure outer side walls. Van Buskirk's (U.S. Pat. No. 4,440,306) closure is limited to the manufacture's model unlike the present invention in which the double closures are separable using the invention's Double Closure Separator.

SUMMARY OF THE INVENTION

The invention relates to utilizing rotational movement of post manufactured containers having a round upper portion, and post manufactured double closures, to create time indicating containers, and closures, comprising a post manufactured container having a rotatable pointer, a separable double closure having an outer closure cap and an inner closure cap. Time indicating indicia is placed on the side wall of the inner closure cap. The time indicating container further comprises a pill cup separator, to separate the pills dosages of the week from the main supply of pills dosages. The today's time indicators containers and closure are limited to the manufacturer's model, the time indicating features cannot be applied to other containers and closures. The cost of tooling up to make a time indicating container, and closure is very expensive, so expensive that there are no time indicating containers, and closures on the market today. The past time indicators failed to enjoy economic success on the open market.

More and more hospitals are closing, ward and emergency rooms are becoming out-patient clinics. With more and more out-patients administering stronger medications, improved technology advancements are needed. There has been no movement in this field to help out patients.

OBJECTS AND ADVANTAGES OF THE PROPOSED INVENTION

A. Provide time indicating means for any container with a round upper portion.

B. Provide double closure separator tool to separate double closures.

C. Provide time indicating containers and closures which can be produced on a large scale and distributed economically.

D. Provide containers and closures that have multiple ways of reminding patients when to take medication that could be used on existing closures and container outer walls.

E. Provide an organized means of securing pill dosages in a secondary container from the main supply of pills as well as having a child resistant mechanism.

F. Provide a secondary container means to help patients have a better record of the amount of pill dosages taken in a given time period.

G. Provide a container and closure that blind and low vision individuals will be able to utilize.

H. Provide a tool to remove jammed caps and jars.

I. Provide a container and closure whose labeling can be manually installed in about 15 seconds, using pre-made stick-on labeling and snap-on pointers, or twist-on pointers and thread-on pointers that indicate the time periods.

J. Provide a container and closure which can come prefabricated from the manufacturer: by means of plastic molding of raised or resisted lettering, a paper made label may be applied.

K. Provide pre-made stick-on labels for identifying all drugs or the purpose which can be applied to medication containers or secondary containers.

L. Provide means to aid in the taking of prescription or over the counter medication.

M. Provide means of keeping track of work hours by setting one pointer to display time work started and a second pointer to display the time work ended.

O. Provide secondary containers to separate large numbers of pills into small number of pills to take advantage of visual recall.

P. Provide a means of separating double closures with a Double Closure Separator.

BRIEF DESCRIPTION OF THE DRAWING

FIG. 1 is a plan view of a wire rotatable pointer trained and capped.

FIG. 2 is a plan view of an optional plastic attachable rotatable pointer.

FIG. 3 is a perspective view of a pill cup separator secondary container.

FIG. 4 is a plan view of a wire trained and twisted to a point to make a rotatable pointer.

FIG. 5 is a front elevation view of a multi-time indicating post manufactured container showing the rotatable pointer wire ends pointing at time indicia on the container and the other wire end pointing at the indicia on the outer closure cap.

FIG. 6 is an exploded view of a post manufactured multi-time indicating container, separable double closure and pill cup separator assembly.

FIG. 7 is a front elevation view of a fully assembled multi-time indicating post manufactured container double closure and sealed-in-container out-of-view pill cup separator.

FIG. 8 is a front elevation view of the time indicating post manufactured container and closure, shown with Braille indicia.

FIG. 12 is a front elevation view of the double closure separator tool in position to remove the outer closure of a double closure.

FIG. 13 is a perspective view of a plastic vinyl cap used to cover rotatable pointed end.

FIG. 14 is a front elevation view of the double closure separator removing a frozen-tight closure cap.

REFERENCE NUMBERS IN DRAWINGS

Figure 9:
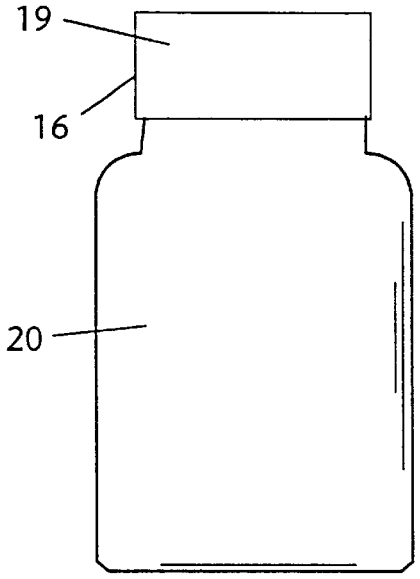
FIG. 9 is a front elevation view of the threaded inner closure cap and container after separation.
Figure 11:
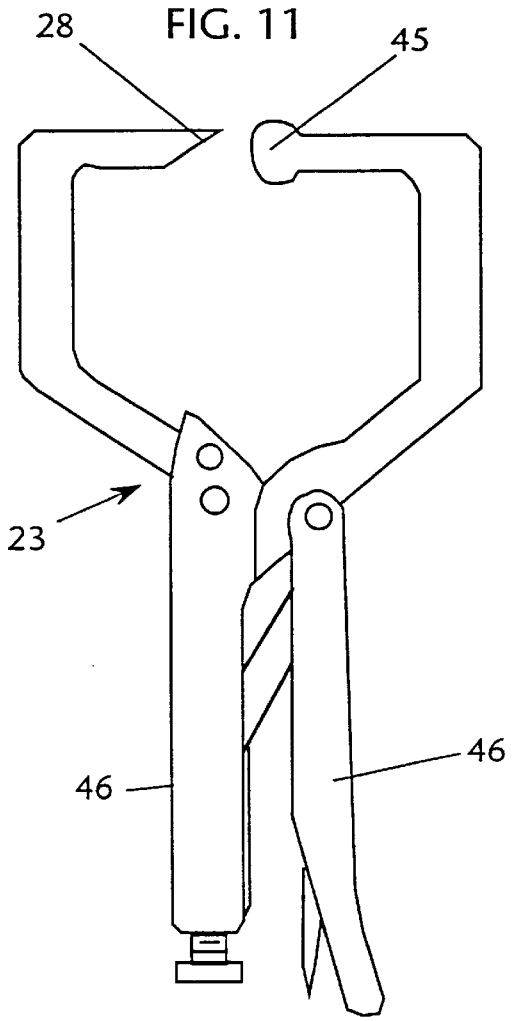
FIG. 11 is a plan view of a Double Closure Separator tool.
Figure 10:
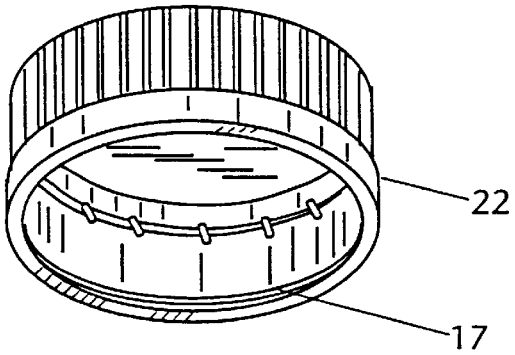
FIG. 10 is a perspective view of the threaded inner closure cap and container after separation.

16. Inner closure cap outer side wall.
17. Retainer bead.
18. Outer closure cap underside.
19. Threaded inner closure cap.
20. Time indicating container body.
21. Time indicating double closure.
22. Outer closure cap.
23. Double closure separator.
24. Plastic vinyl pointer cap.
25. Container body indicia.
26. Outer closure cap side wall indicia.
27. Wire rotatable pointer
28. Separator wedge blade tip.
29. Attachable plastic rotatable pointer.
33. Multi-time indicating container separable double closure and pill cup separator assembly.
34. Outer closure cap side wall view hole.
36. Container body Braille indicia.
39. Inner closure cap outer side wall indicia.
40. Pill cup separator.
41. Rim of main container.
43. Pill cup body.
44. Pill cup rim.
45. Round clamp tip.
46. Clamp handle.
47. Locking means.
48. Adjustment screw.

DESCRIPTION OF THE PREFERRED EMBODIMENT

Referring specifically to FIG. 7 showing an enlarged assembled view of the Multi-Time Indicating Post Manufactured Double Closure Container and Pill Cup Separator Assembly 33, comprising as seen in the exploded view in FIG. 6 of the time indicating post manufactured container body 20, a post manufactured pill cup separator 40 which is as improved secondary container, and time indicating post manufactured separable double closure 21.

The container body 20 comprises time indicating indicia 25, which is applied around the upper round portion of the existing post manufactured container body 20. The container body 20 further comprises an independent attachable rotatable pointer 27 which is trained wire as seen in FIG. 6, FIG. 7, FIG. 4 and FIG. 1. The wire is trained tightly around the upper circular portion of container body 20 to rotate on an axis around the upper portion of container 20, the wire ends are twisted into a point and then bent to point at the time indicating indicia 25 around upper portion of container body 20. A plastic vinyl cap 24 as seen in FIG. 13 is applied to the end of the twisted wire point of the rotatable pointer 27 to protect fingers from injury. To function time indicating container body 20, follow the steps below:

A. Hold container body 20 firmly;

B. Rotate pointer to desired time indicating indicia 25 setting, on the upper portion of container body 20.

This time indicating function can be applied to any post manufactured container body 20 with a round upper portion. The attachable rotatable pointer 27 can be attached to any container with an upper round portion.

Optional materials include as seen in FIG. 2 a C shaped plastic rotatable pointer 29 having fixable walls which yield to fit tightly around the upper round portion of the container body 20 and other round containers when attached.

The pill cup separator 40 is a post manufactured closureless miniature pill cup separator 40, and comprises miniature pill cup body 43 having a thin rim 44 and a predetermined diameter opening to allow the pill separator's rim to rest directly on container 20 entrance rim 41. The pill cup separator 40 further comprises a closureless pill cup separator body 43 which extends inside the container body 20, and is sealed when threaded inner closure 19 is joined to the container body 20 by threads. The pill cup separator 40 is used to separate a predetermined number of dosages from the main supply of pill dosages with each dosage representing any desired time period; for example, a week's supply of pill dosages, each dosage representing one day. The pill cup separator 40 improves a person's automatic recall of how many pills are left to be taken in a given time period, and to indicate how many pills have been taken in a given time period; for example, if there are ten pills dosages in sight and two are taken away, your visual recall without counting the pill dosages left would automatically tell your brain there is eight dosages left. The pill cup separator 40 comes in various sizes to accommodate the different size container 20 entrance diameters.

The post manufactured Time Indicating Double Closure 21 comprises the threaded inner cap 19, which is separable with a Double Closure Separator 23 that comprises a common locking C-clamp having a standard round clamping tip 45 and a Separator Wedge Blade Tip 28. The wedge blade 28 fits in between the double closure 21, and the standard round tip 45 is placed on the top of the outer closure cap 22. Adjustment screw 48 is used to set a desired opening, and separator 23 is locked in place by locking means 47. Clamp handles 46 are squeezed using upward hand pressure between the container threaded joining means 42 and the inner closure cap 19 outer side walls 16 at retainer bead 17, as seen in FIG. 12. The outer closure cap 22 and the threaded inner closure cap 19 are separated, and configured to indicate, using the following steps:

a) a place the separator wedge blade 28 of the separator 23 to fit in between the outer closure 22 and the threaded inner closure 19;

b) use adjustment screw 48 on handle 46 to set desired opening;

c) place the standard round tip 45 of the separator tool 23 on top of the outer closure 22;

d) lock separator 23 in place with locking means 47 on handle;

e) while the container body 20 and the double closure 21 are attached, apply upward squeezing hand pressure to the separator's handles 46 and the outer closure cap 22 will come off, exposing the inner closure cap 19;

f) place view hole 34 through the outer closure side wall;

g) apply time indicating indicia 39 to inner closure's side wall 16 to indicate when medication was last taken, the time next dosage should be taken, the last day said inner closure having internal threads for engaging external threads on said container body, and an hour a dosage was last taken, or other time periods;

h) rejoin double closures 21 by placing outer closure 22 over inner closure 19, then applying pressure to closures against a hard surface until outer closure 22 snaps back in place over inner closure cap 19 and the outer closure's retaining bead 17;

i) with container 20 and closure 21 rejoined, rotate outer closure cap 22 with view hole 34 to desired time indicia on threaded inner closure cap's outer side wall indica 39.

This method will provide a second time indication point giving the time indicating method multi-time indicating functions when used in conjunction with the time indicating container 20 to aid out-patients, parents, health care workers in charge of administering medications, by indicating two periods of the last day and hour, and other time periods medications are taken.

FIG. 14 and FIG. 12 shows the post manufactured double closure 21 which is separable at the outer closure 22 retainer bead 17 to allow time indicating indicia 39 to be placed around the inner closure cap 19 outer side wall 16 skirt. The outer closure cap 22 further comprises the view hole 34 at the outer cap side wall 15 skirt for viewing time indicating indicia 39 on the inner closure cap 19 side wall 16. To function as a time indicating double closure 21 follow the steps below:

a) rejoin outer closure cap 22 around inner closure cap 19, the outer closure cap 22 is held in place by a retaining bead 17 around the lower underside 18 skirt of the outer closure cap 22, the outer closure 22 and inner closure 19 will snap back in place using hand pressure against a hard surface. The outer cap 22 rotates around on an axis around the inner cap 19;

b) rejoin the time indicating double closure 21 to time indicating container body 20, sealing the pill cup separator 40 at the same time, as seen in FIG. 7.

c) while holding container body 20, firmly rotate outer closure cap 22 view hole 34 to desired time indicating indicia 39 which is on the outer side wall 16 of the inner closure cap 19. Along with the time indicating container this will provide a second time indicating setting allowing multi-time indicating setting capabilities, as seen in FIG. 7 of a fully assembled time indicating post manufactured multi-time indicating container 20, pill cup separator 40, and separable double closure 21. The pill cup separator 40 comes in various sized to accommodate the different size container 20 entrance diameters.

The time indicating container 20 and time indicating closure 21 are used in conjunction and in combination to indicate two time periods at the same time. These periods could indicate the day of the week medication was last taken, and one of the hours of the day medication was last taken. For example, if medication was last taken Monday at 8 p.m., to indicate these time periods, use the following steps:

a) hold container body 20 and rotate outer closure 22 to desired day of the week (Monday);

b) hold container 20 and rotate attachable pointer 27 to desired hour of the day (8 p.m.). This method will reduce overdosing, and underdosing.

Another embodiment of the invention, shown in FIG. 5, shows the rotatable pointer 27 pointing at time indicating indicia 26 on the outer side wall 15 surface of the outer closure cap 22 and the other end of the pointer 27 pointing at time indicating indicia 25 on the container body 20 to provide a two way time indicating function using the following steps:

a) hold container 20 and pointer 27 firmly still and rotate outer closure cap 22 to desired time period;

b) hold time indicating closure cap 21 and rotatable pointer 27 firmly still on setting and turn time indicating container 20 to desired time period. This will provide two time indicating settings, one on the container body 20 and the other on the outer closure cap 22 outer side wall 15, as seen in FIG. 5.

The double closure separator 23 has optional usages. For example, the separator 23 is used as a jar opener, bottle opener, and frozen, stuck closure cap remover as seen in FIG. 14. This function works with double closures 21 and single closures, using the following steps:

a) place separator blade between container joining means 42 and closure 21 underside;

b) use adjustment screw 47 on handle 46 to set desired opening;

c) place the standard round tip 45 of the separator tool 23 on top of the closure 21;

d) lock separator 23 in place with locking means 48 on handle;

e) while container body 20 joining means 42 and closure are attached, apply upward squeezing hand pressure to the separator's handles and the outer closure cap will come off the container.

FIG. 8 shows the time indicator container body 20 with Braille indicia 36, applied to container upper portion.

RAMIFICATIONS

1. The rotatable pointer could be designed to thread down the container threads and rotated to desired time indicia on container body and held in place when the inner closure cap is joined to the container.

2. The double closure caps could be separated at the manufacturer then shipped out separated.

3. The attachable rotatable pointer can be made out of optional materials such as plastic, paper, rubber, and other materials.

4. The multi-time indicating container and closure has other usages, can be used to indicate travel time from one point to another, by using hourly time indicia on the closure and on the container body.

5. All multi-time indicating features can be manufactured, and applied at the time of manufacturing of container and closure.

6. Retainer bead could be reduced in size at time of manufacturing, so as to allow outer closure cap to separate with hand pressure only.

7. The double closure separator can be made without locking device.

8. The double closure separator can be made with one handle, with the wedge blade tip which fits in between the outer closure and the inner closure attached to the handle, the handle is used for leverage against the outer cap when separating is done.

9. The double closure separator made from metal can be made from other materials; for example, plastic.

10. The double closure separator has other usages; for example, a bottle opener, to remove frozen tight jar lids.

11. The double closure separator is used to open frozen tight pill closures.

12. The multi-time indicating container and closure can be used to indicate when a person started work on the container and indicate when a person stopped work on the closure. It should be understood that the specific embodiments illustrated of this particular invention are not all-inclusive but are merely for purposes of more clearly understanding the invention, it being within the scope and spirit of the claims and invention to make such modifications and variations and find other usages as would be apparent to a person of ordinary skill.

What is claimed is:

1. A time indicating container, comprising:

a container body having an opening, said container body adapted to hold a supply of pills;

a separable double closure comprising an outer closure and a threaded inner closure received concentrically within said outer closure said inner closure having internal threads for engaging external threads on said container body, said outer closure being securable about said opening and said inner closure dimensioned to close said opening by mating engagement of said internal and external threads;

a post manufacture pill cup separator dimensioned to be inserted in said opening of said container body and adapted to retain and separate a predetermined number of said pills from the supply of pills disposed in said container body;

indicia means for indicating time periods, including indicia applied to the outer surface of said container body adjacent to said opening;

pointer means directed at said indicia for indicating a selected time, said pointer means including a bendable wire extending about said container body adjacent to said opening, said wire having opposed ends twisted together, and a plastic cap secured about said twisted ends to define at least one pointer.

2. The time indicating container of claim 1, wherein said indicia means includes indicia applied to the outer surface of said outer closure, and said at least one pointer is a pair of pointers extending in generally opposed directions, one of said pair of pointers extending toward said indicia on said container body and the other of said pair of pointers extending toward said indicia on said outer surface of said outer closure.

* * * * *